US005161502A

United States Patent [19]

Fritz

[11] Patent Number: 5,161,502

[45] Date of Patent: Nov. 10, 1992

[54] METHOD AND ARRANGEMENT FOR SETTING AN IDLE AIR ACTUATOR

[75] Inventor: Adolf Fritz, Ditzingen, Fed. Rep. of Germany

[73] Assignee: Robert Bosch GmBH, Stuttgart, Fed. Rep. of Germany

[21] Appl. No.: 806,270

[22] Filed: Dec. 13, 1991

[30] Foreign Application Priority Data

Dec. 13, 1990 [DE] Fed. Rep. of Germany ..... 4039761

[51] Int. Cl.[5] ..... F02D 41/12; F02D 41/16

[52] U.S. Cl. ..... 123/327; 123/339; 123/320

[58] Field of Search ..... 123/327, 328, 339, 320, 123/324

[56] References Cited

U.S. PATENT DOCUMENTS

| | | | |
|---|---|---|---|
| 3,868,933 | 3/1975 | Bigalke et al. | 123/339 |
| 4,438,744 | 3/1984 | Hasegawa | 123/339 |
| 4,465,043 | 8/1984 | Denz et al. | 123/339 |
| 4,597,047 | 6/1986 | Deutsch | 123/339 |

*Primary Examiner*—Andrew M. Dolinar
*Attorney, Agent, or Firm*—Walter Ottesen

[57] ABSTRACT

The invention is directed to a method for adjusting the idle air actuator in the intake system of an internal combustion engine during idle or overrun operation, the method comprising the steps of: transferring the idle air actuator into a non-driven position in a load area outside the idle or overrun operation; continuously monitoring outside of idle and overrun operation as to whether such a change of operating variables takes place which makes a transfer into idle or overrun operation probable; and, if so, driving the idle air actuator with a value which is determined so that the idle air actuator assumes that position, which, when reaching idle or overrun operation, will presumably by substantially the correct position. The method of the invention affords the advantage that the power loss for driving the idle air actuator is considerably reduced without disturbances (caused by intermittent non-driving of the actuator) occurring in the performance of the engine during transitions from the driven into the non-driven state and vice versa.

7 Claims, 2 Drawing Sheets

METHOD AND ARRANGEMENT FOR SETTING AN IDLE AIR ACTUATOR

FIELD OF THE INVENTION

The invention relates to a method and an arrangement for setting the idle air actuator in the air-intake system of an internal combustion engine. More particularly, the invention is concerned with idle air actuators which do not remain in the last-adjusted position when the electric drive is suspended but instead move into a base position. Idle air actuators can be mounted in the bypass of an intake system or constitute a controllable throttle flap stop.

BACKGROUND OF THE INVENTION

U.S. Pat. No. 3,868,933 discloses controlling an idle air actuator mounted in a bypass for only as long as idle is present. However, as soon as the throttle flap in the main intake channel opens, the idle air actuator is switched so that it is without current whereupon it assumes a base position, preferably a center position. The idle air actuator is again driven when the idle is reached or when a resume engine speed is reached for overrun cutoff.

This method has the disadvantage that unevenness in the air flow occurs during current cutoff as well as when the idle air actuator is again switched on. This unevenness in the air flow negatively influences the driving performance of an internal combustion engine driven pursuant to this method.

Accordingly, it has been the basic practice to continuously drive the idle air actuator whereby the condition has been fully precluded that switch-off and switch-on disturbances occur. In refined methods, the control which is present when leaving the last idle condition is not continuously maintained; instead, the drive value is modified in dependence upon changes in the operating conditions. If the idle condition were left for the last time, for example, when the engine was relatively cold, and then the engine temperature increases because of the continued operation thereof, the control corresponding to the changed engine temperature would change in the direction of reduced air throughput through the bypass such that, when idle is reached, the desired idle engine speed is again adjusted. If deviations from the desired engine speed occur, then these are compensated for by an idle control. It should now be noted that refined systems consider not only the idle case but also the resume case during overrun cutoff. In an operation of this kind, a somewhat larger air cross section in the bypass is provided than in the idle case. The basis for the corresponding drive of the idle air actuator is however the drive value present when the idle condition was last left as this value was modified because of changes in the operating conditions.

The continuous drive of the idle air actuator leads to power losses which are considerably higher than, for example, the driving of the injection valves. The power loss, which is caused by the driving of the idle air actuator, amounts to up to 25% of the total power loss of a control apparatus. The relatively high power loss must be considered with the construction of the control apparatus pursuant to spatial distribution and usable components. All these disadvantages have however been accepted for years in order to avoid the above-mentioned other disadvantages which occur when the idle air actuator is switched to zero current when leaving idle and driven only when reaching idle or the resume engine speed with overrun cutoff.

SUMMARY OF THE INVENTION

It is an object of the invention to provide a method and an arrangement for setting the idle air actuator in the intake system of an internal combustion engine which leads to lower power loss without disturbances in the operating performance of the engine.

The method according to the invention for setting the idle air actuator in the intake system of an internal combustion engine is for the case of idle or overrun operation and includes the steps of: transferring the idle air actuator into a non-driven position in a load area outside of idle or outside of overrun operation; outside of idle and overrun operation, continuously monitoring as to whether a change in operating variables occurs so that a transfer into the idle or overrun operation is probable; and if so, driving the idle air actuator with a value which is determined to cause the actuator to assume the position which would presumedly be the correct position when reaching idle or overrun operation.

What is decisive in this method is that driving the idle air actuator does not take place when the idle condition has already been reached; instead, the idle air actuator is driven when such a load reduction takes place that a transition into idle is likely. In this way, a timely response is provided with respect to resuming the drive of the idle air actuator so that the actuator again assumes the correct idle position when the idle conditions have actually been reached. In most cases, the transition from the non-driven condition into the driven condition takes place so slowly that the change of the effective cross section of the bypass leads to no disturbances.

For internal combustion engines with fuel injection, a resumption of the injection in the overrun cutoff starting with a so-called resume engine speed is provided The setting value corresponding thereto for the idle air actuator is read out of a overrun characteristic. If such an overrun characteristic is stored, it then affords the advantage that with the method of the invention, the idle air actuator is set to the actual value from this characteristic when it is to be assumed from changes of the operating variables that overrun has been reached If no such characteristic is available, or it is to be assumed that idle occurs without overrun, then the adjustment advantageously takes place to a drive value which is related to the drive value with which the air actuator was driven just before leaving the idle control case. This value is stored. The new drive can take place directly with this stored value, however, it is more advantageous to store corresponding values of operating variables together with the last drive value and to compute a new drive value from the stored values and actual values of operating variables.

It is to be noted that the use of the above-mentioned values corresponds to conventional procedure. However, in conventional procedure, the idle air actuator is continuously driven by a value from an overrun characteristic or by a value which is continuously computed in the manner last-mentioned above. The difference to known methods is not seen in the manner in which driven values are obtained; instead, that outside of idle and overrun the driving occurs not continuously but only then again, when it is to be assumed, based on changes of operating variables, that idle or overrun operation will soon be reached.

The investigation as to whether idle will probably be reached is done by investigating the absolute load condition as well as load reductions with respect to speed and extent. If after the presence of higher load, the lower part-load range is slowly reached again, the presumption is made it is probable that idle will be reached soon or resume operation in the overrun cutoff will be reached. For this reason, the air actuator is driven in this case. Driving then takes place when, in the upper load ranges, a large drop in load takes place within a short time.

The values of operating variables with which control of the idle air actuator is no longer possible are determined for each vehicle by experimentation. The most important point for optimization is that the drive of the idle air actuator is not stopped directly after moving out of idle operation; but only then, when such values of operating variables such as load values are reached which provide a reliability range which is adequate to control the air actuator in time before reaching idle. The point of terminating the drive can for example be determined by the position of the accelerator pedal; however, it should be noted here that for a heavy vehicle having a weak engine, the displacement angle of the accelerator pedal is selected relatively large starting from that angle at which the air actuator is no longer driven. A cutoff of the idle actuator takes place often while for a lighter vehicle with a very powerful engine, the above-mentioned angle must be selected very small to ensure that the drive of the idle air actuator can be adjusted to a reasonable degree.

It is further advantageous if the transitions from the driven into the non-driven position and vice versa take place as slowly as possible. For the first-mentioned transition, this is always realizable without problems. For the transition from the non-driven into the driven position, a slow change is however not always possible, especially not when the engine is transferred slowly into the range of low part load and then suddenly the load is reduced further. In a case of this kind, a slow displacement would be disadvantageous; rather, it would then even be advantageous to provide a temporary overdrive of the idle air actuator compared to the actual position required so that the actuator reaches the desired position especially rapidly via this overdrive.

The arrangement according to the invention is for setting the idle air actuator in the intake system of an internal combustion engine in the case of idle or overrun operation with the idle air actuator assuming a base position in the non-driven condition. The arrangement includes: a unit 18 for switching off the drive of the idle air actuator 11 outside of idle or outside of overrun operation; this unit 18 being adapted for monitoring outside of idle and overrun operation as to whether a change of operating variables takes place such that a transition into idle or overrun operation is probable and to drive the idle air actuator in the event that this is the case with a value which is determined such that the actuator takes on that position which would presumedly be essentially the correct position when reaching overrun operation or idle with said value being determined in a conventional manner by means of an appropriate configuration of the unit.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
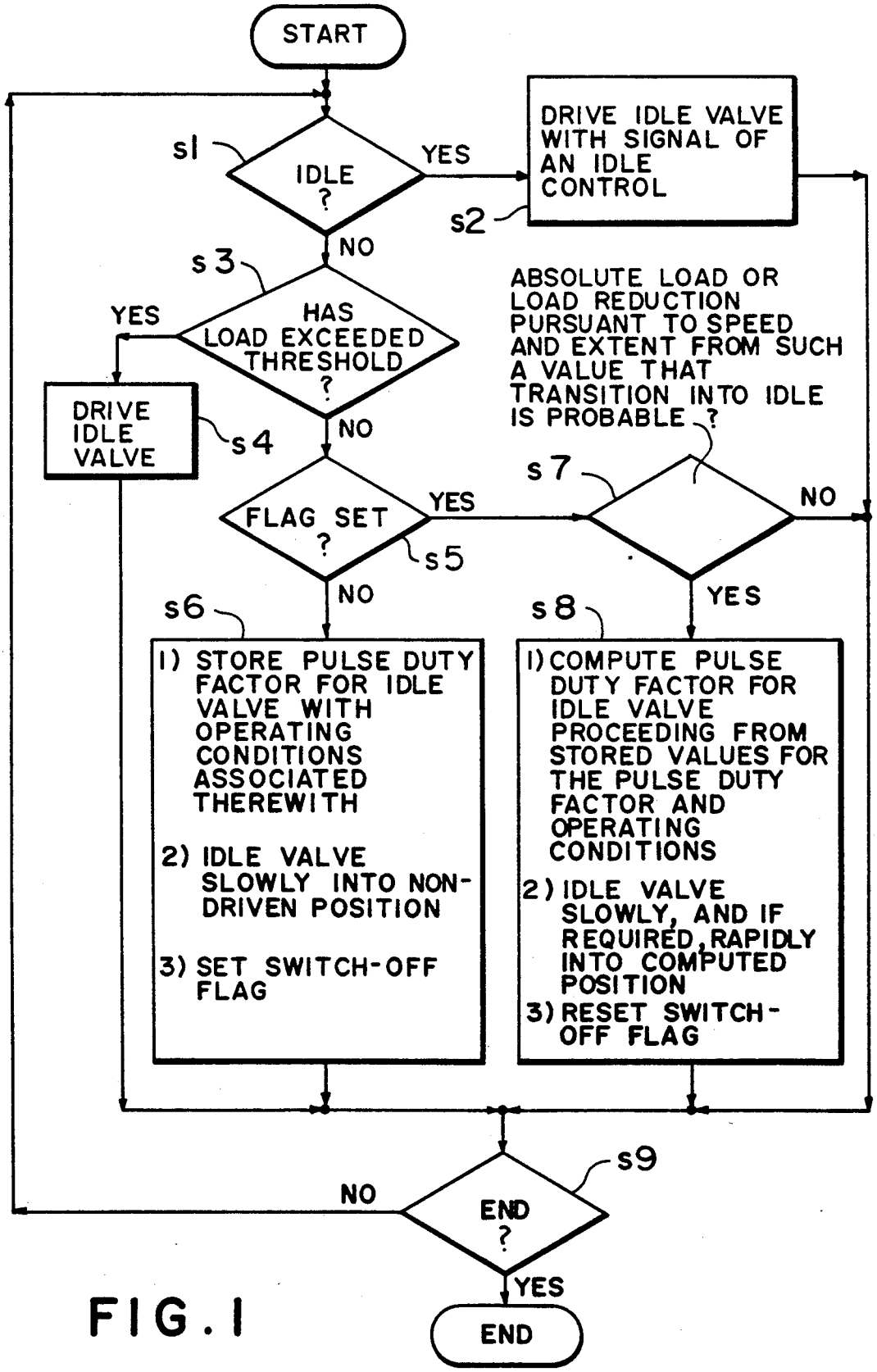
FIG. 1 is a flowchart for the method wherein the idle air actuator is transferred into a non-driven position when a load threshold is exceeded and wherein the actuator is again driven when it becomes probable that idle will be reached; and, FIG. 2 is a block diagram of an arrangement for carrying out the method shown in FIG. 1.

The flowchart of FIG. 1 concerns only the drive of the idle valve and therefore no details of an idle control as such are provided. According to the sequence illustrated, an investigation is first made (step s1) as to whether idle is present. If this is the case, then in step s2, a drive of the idle valve takes place in accordance with the output signal of an idle control. This output signal typically fixes a pulse duty factor with which at least one actuator element for the idle valve is charged. The position of the valve is dependent upon the pulse duty factor. After step s2, a step s9 is reached in which a check is made as to whether the method is to be ended, for example, because the ignition has been switched off. If this is not the case, then there is a return to step s1; otherwise, the method is ended.

If the determination is made in step s1 that no idle is present, then a check is made in a step s3 as to whether the load has exceeded a threshold which, in the embodiment shown, is defined by reaching the region of the upper part load. If this load threshold has not yet been exceeded, then a step s4 follows wherein the idle valve is driven on the basis of the pulse duty factor present when leaving the last idle condition. The drive value is however modified when the operating conditions have since changed especially when the engine temperature has increased. It is noted that according to steps s2 and s4, the idle valve is not just then driven when these steps have been reached; instead, in these steps, the pulse duty factors are specified which are to be maintained until the next particular step is reached. With the conclusion of step s4, the method goes to step s9 as was the case at the conclusion of step s2.

If in step s3, it is determined that the load has exceeded the pregiven threshold, then thereafter in step s5, by interrogating a switch-off flag, a check is made as to whether exceeding this threshold has been determined previously and the drive of the idle valve is switched off. If this is not the case, then a step s6 follows wherein the actual pulse duty factor for the idle valve is stored with corresponding operating conditions. Furthermore, the idle valve is slowly transferred into the non-driven position. The non-driven position is preferably a center position. This position is reached in the embodiment within very few seconds starting from the last driven position. Finally, in step s6, the switch-off flag is set so that the next time step s5 is reached, a determination can be made that step s6 does no longer have to be worked through. Thereafter, step s9 is reached again.

If in step s5 it develops that the load threshold interrogated in step s3 has already been previously exceeded, then, in step s7, a check is made as to whether the absolute load or the load reduction takes on such a value as to speed and extent that a transition from load to idle is probable. If this in not the case, the idle valve remains in the non-driven condition and step s9 is reached. Otherwise, a step s8 follows wherein the pulse duty factor for the drive of the idle valve is computed starting from the pulse duty factor stored in step s6 as well as from the stored and actual operating conditions. In the embodiment, it is presupposed that first a pulse duty factor for the resume case in the overrun cutoff is intended to be set. For this purpose, first, and starting from the stored idle pulse duty factor, an idle pulse duty factor is computed modified by the operating conditions, that is, for example a pulse duty factor for reduced cross section in the bypass when the engine temperature has increased since the last pulse duty factor was stored. The modified value is then increased by a pregiven percentage in order to compute the drive value for the resume case in overrun operation. It is however also possible to preset a special pulse duty factor for this resume case. The idle valve is transferred as slowly as possible into the position corresponding to this pulse duty factor on the basis of the computed or fixed pregiven pulse duty factor. This can take place within several seconds when the drive takes place because the absolute value of the load has dropped below a threshold. If in step s8 however a determination is made that during this drop there has been a drop below a still lower threshold or if step s8 is reached because in step s7 a large drop in load according to speed and extent had been determined, the displacement of the idle valve takes place faster. If necessary, even an overdrive is undertaken in order that the desired position is reached as fast as possible. In this connection, it is also possible that the first provided drive value for the resume case in overrun operation is again left in order to drive to the position required for idle. However, this corresponds to the usual procedure according to the various methods that the idle valve is transferred into a resume position when the idle has been left. Also in this case, a rapid switchover from this position to the idle position must be made if it is detected after a drop below the resume engine speed that actually the idle condition is reached.

Finally, in step s8, the switch-off flag is reset so that the detection can be made in step s8 that the idle valve is again driven.

Of special significance for the method described is that the idle valve is no longer driven outside of the idle condition and that the resume drive already takes place if a transition of load after idle is probable. Preferably, the drive is not suspended directly after leaving idle; instead, the drive is suspended only after a higher threshold so that adequate time is available for the resume drive which will presumedly occur.

As mentioned above, in the vehicle of the embodiment, the threshold interrogated in step s3 is the limit between lower and upper part load. This corresponds to a throttle flap angle of approximately 35°. However, the value is dependent greatly on the particular overall performance of an internal combustion engine and a vehicle. The detection of the load condition can take place in any desired known manner, that is by interrogating the throttle flap angle as already mentioned or via the measurement of the air mass drawn in by suction (hot-wire air-flow sensor) or the pressure in the intake pipe. The absolute load on which a decision is made in step s7 that the idle valve is again to be driven lies in the lower part-load range in the embodiment, namely at approximately a quarter of the maximum possible engine power. 20 degrees of throttle flap angle per second was determined as a load reducing threshold with a minimum change of 10 degrees within one second. A change of 5 degrees within a tenth of a second without a further displacement still does not trigger a resume switch-on of the idle valve since the absolute change of 10 degrees within one second has not been reached even with 50 degrees per second of gradient of 20 degrees per second. Which values are optimal for which a particular application is very dependent upon the dynamic performance of an engine. The values are to be applied for each application such that the drive of the idle valve is interrupted as often as possible but that with great probability that position is present when reaching idle or the resume condition for overrun cutoff which would be present with an application of the method usually performed at continuous drive of the idle valve.

The idle valve which is preferably used has, as mentioned, a mean opening cross section in its non-driven position so that corrections must be taken only from this cross section. In this way, a control from cross section zero is not always necessary. Such a valve simplifies the function, is however not absolutely necessary.

An arrangement for carrying out the method described above is shown in FIG. 2 and is explained below.

Figure 2:
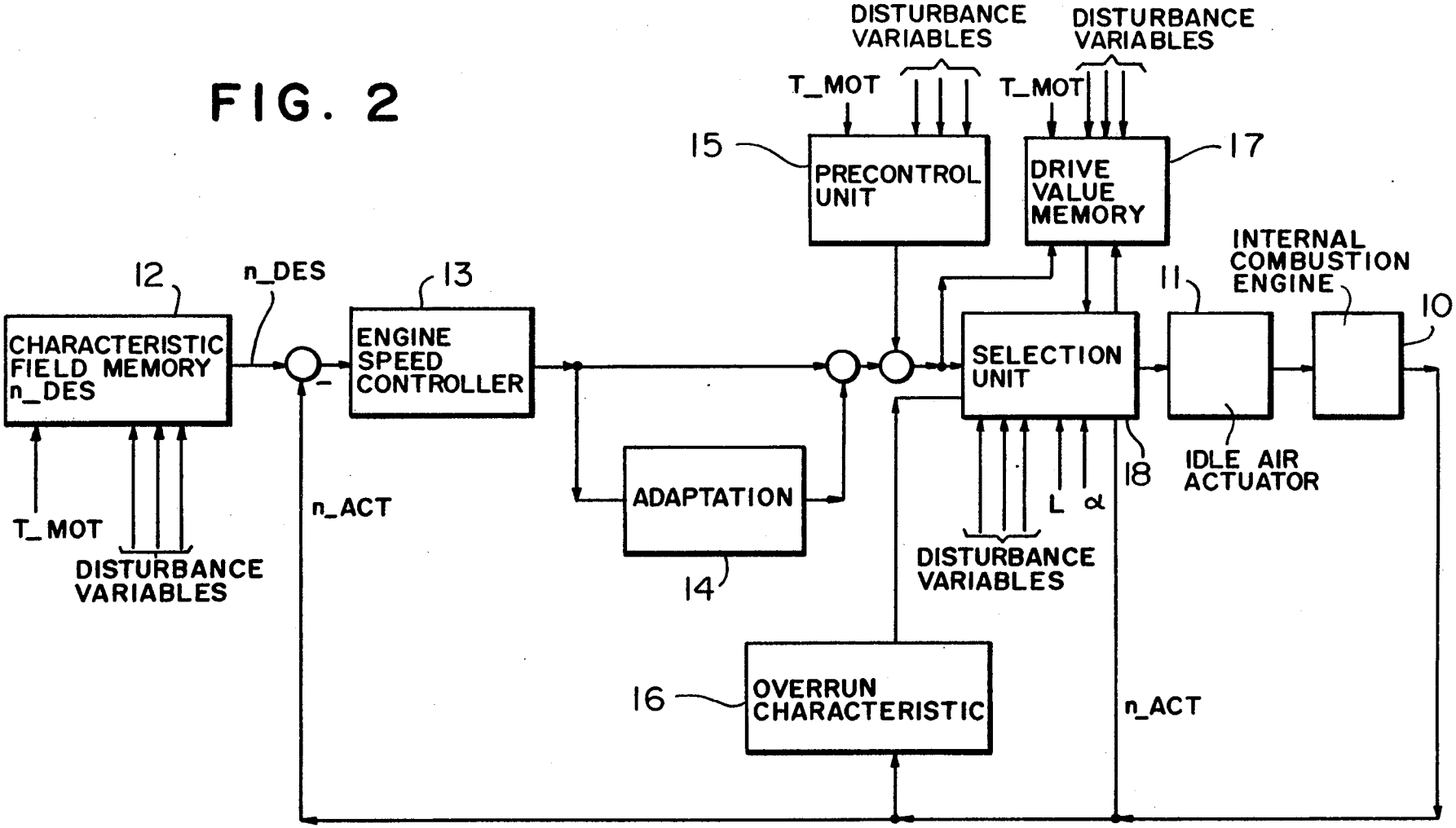

The arrangement according to FIG. 2 includes the following function groups: an internal combustion engine 10 having an idle air actuator 11, a characteristic field memory 12 for idle desired engine speeds n_DES, an engine speed controller 13, an adaptation unit 14, a precontrol unit 15, an overrun characteristic memory 16, a drive value memory 17 and a selection unit 18.

In the case of idle control, precontrol values are emitted by the precontrol unit 15 in dependence upon engine temperature T_MOT and in dependence upon values of disturbing variables (such as transmission position and switching condition of an air conditioner). These precontrol values are so pregiven that a desired idle engine speed is reached quite accurately when the idle air actuator 11 is driven with these precontrol values. In order to be able to more precisely adjust the particular desired engine speed, a desired engine speed is emitted in dependence upon values of the engine temperature and in dependence upon disturbing variables of characteristic field 12 with this reference engine speed being compared to the actual engine speed n_ACT. From the control deviation formed from this comparison, the engine speed controller 13 generates a position signal which, together with values of the adaptation unit 14 which evaluates the position signal, modifies the particular actual precontrol value. The position signal formed from the precontrol value and adapted controller position signal is, in the case of idle control, passed by the selection unit 18 to the idle air actuator 11 in order to adjust the actuator corresponding to the signal.

In the case of overrun, an actuator signal is read out of the overrun characteristic memory 16 in dependence upon the engine speed at that time and this signal is transmitted from the selection unit 18 to the idle air actuator 11.

The selection unit 18 is supplied with values for load, engine speed, throttle flap angle $\alpha$ and disturbance quantities and, from the absolute values and the rate of change of these values of these variables, the selection unit 18 determines in accordance with the method sequence described above when the idle air actuator 11 is to be driven with which signal. When there is a move out of idle or overrun operation and specific threshold values are exceeded such as described above, the selection unit 18 emits a signal to the drive value memory 16 so that the current values for driving the idle air actuator and operating variables and disturbing variables can be stored. Thereafter, the drive of the idle air actuator 11 is terminated whereupon the actuator 11 runs into its base position. If changes occur during further operation which give appearance that overrun operation will be reached in a short time, the idle air actuator 11 is supplied (by a corresponding selection of the selection unit 18) with a value which belongs to the engine speed at that time from the overrun characteristic memory 16. In contrast, if the changes indicate that idle will be reached in a short time, then the selection unit 18 reads out the values stored in the drive value memory and determines from these values and values for the current operating variables that value which is presumedly the correct value when idle is actually reached. The selection unit 18 supplies this value directly to the idle air actuator 11. If the idle condition is then actually reached, the idle air actuator 11 is then already substantially in the correct position. Residual deviations are then compensated for by the idle control with the aid of the position signal which is formed from the precontrol value and the controller position signal.

It should be noted that FIG. 2 is only a rough schematic of an idle adjusting arrangement. In practical embodiments, the idle air actuator 11 often includes its own subordinated control loop and various arrangements are provided for treating special cases especially for the presetting of actuating values for cold starts and hot starts.

It is understood that the foregoing description is that of the preferred embodiments of the invention and that various changes and modifications may be made thereto without departing from the spirit and scope of the invention as defined in the appended claims.

What is claimed is:

1. A method for adjusting the idle air actuator in the intake system of an internal combustion engine during idle or overrun operation, the method comprising the steps of:

transferring the idle air actuator into a non-driven position in a load area outside of idle or overrun operation;

continuously monitoring outside of idle and overrun operation as to whether such a change of operating variables takes place which makes a transition into idle or overrun operation probable; and, if so, driving the idle air actuator with a value which is determined so that the idle air actuator assumes that position, which, when reaching idle or overrun operation, will presumedly be substantially the correct position.

2. The method of claim 1, wherein the value to which the idle air actuator is adjusted with the assumed return to idle or overrun operation is an overrun characteristic value.

3. The method of claim 1, wherein the last drive value is stored in advance of the transfer of the idle air actuator into said non-driven position; and, said idle air actuator is again driven on the basis of the stored last drive value when said idle air actuator presumedly returns to idle.

4. The method of claim 3, wherein, when storing the last drive values, the values of operating variables which then apply are also stored; and, when again driving the idle air actuator, the then applicable drive value is determined from the stored drive value as well as the stored and the applicable values of operating variables.

5. The method of claim 1, wherein the transition from the non-driven into the driven position of the idle air actuator takes place as slowly as possible but yet so rapidly that when reaching idle or the resume engine speed in overrun operation, the required position is possibly present.

6. The method of claim 5, wherein the drive of the idle air actuator is overdriven for a short time when there is a rapid approach to the idle or the resume engine speed.

7. An arrangement for setting the idle air actuator in the intake system of an internal combustion engine during idle or overrun operation, the idle air actuator assuming a base position in the non-driven condition, the arrangement comprising:

a unit for switching off the drive of the idle air actuator outside of the idle or overrun operation;

said unit being adapted for monitoring outside of idle and overrun operation as to whether such changes of operating variables take place that a transition into the idle or overrun operation is probable; and, for driving the idle air actuator, in the event that said transition does take place, with a value determined by a configuration of said unit such that said idle air actuator assumes that position, which, when reaching idle or overrun operation, will presumedly be substantially the correct position.

* * * * *